US011265646B2

(12) United States Patent
Zhou

(10) Patent No.: US 11,265,646 B2
(45) Date of Patent: Mar. 1, 2022

(54) LOUDSPEAKER MODULE

(71) Applicant: GOERTEK INC., Shandong (CN)

(72) Inventor: Shuzhi Zhou, Shandong (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 16/968,909

(22) PCT Filed: Dec. 24, 2018

(86) PCT No.: PCT/CN2018/123196
§ 371 (c)(1),
(2) Date: Aug. 11, 2020

(87) PCT Pub. No.: WO2019/153916
PCT Pub. Date: Aug. 15, 2019

(65) Prior Publication Data

US 2021/0051395 A1 Feb. 18, 2021

(30) Foreign Application Priority Data

Feb. 12, 2018 (CN) ..... 201810145852.8

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01); *H04R 2400/11* (2013.01)

(58) Field of Classification Search
CPC ..... H04R 1/288; H04R 1/025; H04R 2400/11
(Continued)

(56) References Cited

U.S. PATENT DOCUMENTS

2011/0293121 A1 12/2011 Yan
2013/0148834 A1* 6/2013 Seo ..... H04R 1/2811 381/338

(Continued)

FOREIGN PATENT DOCUMENTS

CN 102065359 A 5/2011
CN 203407016 U 1/2014

(Continued)

OTHER PUBLICATIONS

International Search Report from International Application No. PCT/CN2018/123196 dated Mar. 25, 2019.

*Primary Examiner* — Sean H Nguyen
(74) *Attorney, Agent, or Firm* — Brundidge & Stanger, P.C.

(57) ABSTRACT

Disclosed is a loudspeaker module comprising: a housing; a loudspeaker unit accommodated in the housing and dividing an inner chamber of the loudspeaker module into a front chamber and a rear chamber; a leakage hole formed on the housing at a position corresponding to the rear chamber; and a damping member covering the leakage hole, and being fixed on an outer surface of the housing at an area around the leakage hole, wherein the damping member comprises a sound-permeable damping film and a supporting member bonded together by a first adhesive layer, wherein the supporting member has a first inner hole and is provided on an outer area of the damping film in an annular shape, wherein the first adhesive layer has a second inner hole and is provided on an outer area of the supporting member in an annular shape.

10 Claims, 2 Drawing Sheets

(58) Field of Classification Search
USPC ..... 381/335
See application file for complete search history.

(56) References Cited

U.S. PATENT DOCUMENTS

| | | | | |
|---|---|---|---|---|
| 2014/0193024 | A1* | 7/2014 | Raff | H04R 1/02 381/394 |
| 2015/0086064 | A1* | 3/2015 | Froemel | H04R 1/04 381/394 |
| 2015/0139457 | A1* | 5/2015 | Onishi | H04R 1/2819 381/190 |
| 2015/0373441 | A1* | 12/2015 | Behles | H04R 7/04 381/333 |
| 2016/0088385 | A1* | 3/2016 | Fan | B29C 45/14 381/352 |

FOREIGN PATENT DOCUMENTS

| | | | |
|---|---|---|---|
| CN | 104869482 | A | 8/2015 |
| CN | 105657616 | A | 6/2016 |
| CN | 106162459 | A | 11/2016 |
| CN | 205793236 | U | 12/2016 |
| CN | 206164833 | U | 5/2017 |
| CN | 206517593 | U | 9/2017 |
| CN | 108419188 | A | 8/2018 |
| JP | H08205289 | A | 8/1996 |
| JP | 2932718 | B2 | 8/1999 |
| WO | 2017/176989 | A1 | 10/2017 |

* cited by examiner

LOUDSPEAKER MODULE

TECHNICAL FIELD

The present disclosure relates to the technical field of electroacoustic products, and more specifically, relates to a loudspeaker module.

BACKGROUND ART

A loudspeaker module is an important acoustic component of portable electronic devices to realize conversion between electrical signals and acoustic signals, and is an energy transducing device. The existing loudspeaker module comprises a housing and a loudspeaker unit accommodated in the housing. The loudspeaker unit divides the entire inner chamber of the module into a front chamber and a rear chamber, and the front chamber is communicated with the outside of the loudspeaker module. A lot of heat may be generated during the operation of the loudspeaker unit, which may cause gas expansion and gas pressure increasing in the rear chamber, resulting in an imbalance between gas pressure of the front cavity and the rear chamber, thereby causing an vibration amplitude asymmetry between the up and down vibration of a vibrating diaphragm and deteriorating the performance of the loudspeaker unit. In order to make a balance between gas pressure of the front chamber and the rear chamber and maintain a vibration amplitude symmetry of the vibrating diaphragm, it is necessary to provide a leakage hole on the housing at a position corresponding to the rear chamber to ensure that the rear chamber is communicated with the outside, thereby maintaining a balance between gas pressure of the front chamber and the rear chamber. Since the leakage hole itself has a large leakage capacity, an additional damping film, which has acoustic resistance characteristics, adhered thereto is required to adjust the leakage capacity of the leakage hole, to meet the acoustic performance requirements of the loudspeaker module. Conventionally, the damping film is one of mesh cloth, a sound-permeable film and a non-woven fabric.

During the operation of the loudspeaker unit, when the gas expansion occurs and the gas pressure of the rear chamber increases, the gas will flow to the outside by passing through the damping film via the leakage hole. The way how the gas flows to the outside determines the way how the gas pressure of the rear chamber changes, and also determines whether the vibration amplitude symmetry of the vibrating diaphragm can be maintained. The process of the gas flowing to the outside may be, for example, the gas directly flows to the outside by passing through the damping film via the leakage hole, or the gas flows, with eddy or stationary wave phenomenon and the like occurs, to the outside by passing through the damping film via the leakage hole. However, in the existing loudspeaker module, the configurations and parameters of the leakage hole are fixed, and thus the way that the gas flows to the outside can only be the case that the gas directly flows to the outside by passing through the damping film via the leakage hole, and the vibration amplitude symmetry of the vibrating diaphragm may not be further improved by changing the way how the gas flows to the outside.

Therefore, it is necessary to provide a new loudspeaker module to overcome the above defects existed in the prior art.

SUMMARY OF THE INVENTION

An object of the present disclosure is to provide a loudspeaker module in which the way how the gas flows to the outside via the leakage hole could be changed, thereby further improving the vibration amplitude symmetry of the vibrating diaphragm.

The present disclosure adopts the following technical solutions:

In order to achieve the object of the present disclosure, the present disclosure discloses a loudspeaker module comprising: a housing; a loudspeaker unit is accommodated in the housing and dividing an inner chamber of the loudspeaker module into a front chamber and a rear chamber; a leakage hole formed on the housing at a position corresponding to the rear chamber; and a damping member covering the leakage hole, and being fixed on an outer surface of the housing at an area around the leakage hole.

The damping member comprises a sound-permeable damping film and a supporting member bonded together by a first adhesive layer. The supporting member has a first inner hole and is provided on an outer area of the damping film in an annular shape, and the first adhesive layer has a second inner hole and is provided on an outer area of the supporting member in an annular shape. A surface of the damping film away from the supporting member is adhered to an outer surface of the housing by a second adhesive layer, and the second adhesive layer has a third inner hole.

Wherein a diameter of the first inner hole is less than that of the second inner hole. A buffer chamber is formed between an inner area of the supporting member and the damping film.

Preferably, the diameter of the first inner hole is less than or equal to that of the leakage hole.

Preferably, center axial lines of the first inner hole, the second inner hole, the third inner hole and the leakage hole are located in a straight line.

Preferably, a diameter of the third inner hole is larger than that of the leakage hole.

Preferably, the diameter of the second inner hole is the same as that of the third inner hole.

Preferably, each of the first adhesive layer and the second adhesive layer is a double-sided adhesive tape, and a thickness of the first adhesive layer is equal to or larger than 0.05 mm.

Preferably, the supporting member is formed of metal materials or rigid plastic materials.

Preferably, the rigid plastic materials are PET, PC, PP or ABS.

Preferably, the damping film is mesh cloth or a sound-permeable film.

Preferably, the mesh cloth is a non-woven fabric.

Advantageous Effects

The technical solution of the present disclosure may change the process of the gas flowing to the outside via the leakage hole. That is, one or more of reflection, eddy, resonance and stationary wave phenomena may occur in a space for slowing down the gas flow when the gas flows to the outside via the leakage hole, thereby further improving the vibration amplitude symmetry of the vibrating diaphragm.

DESCRIPTION OF DRAWINGS

The specific embodiments of the present disclosure will be further described in detail below in conjunction with accompanying drawings.

DETAILED DESCRIPTION OF THE EMBODIMENTS

Figure 1:
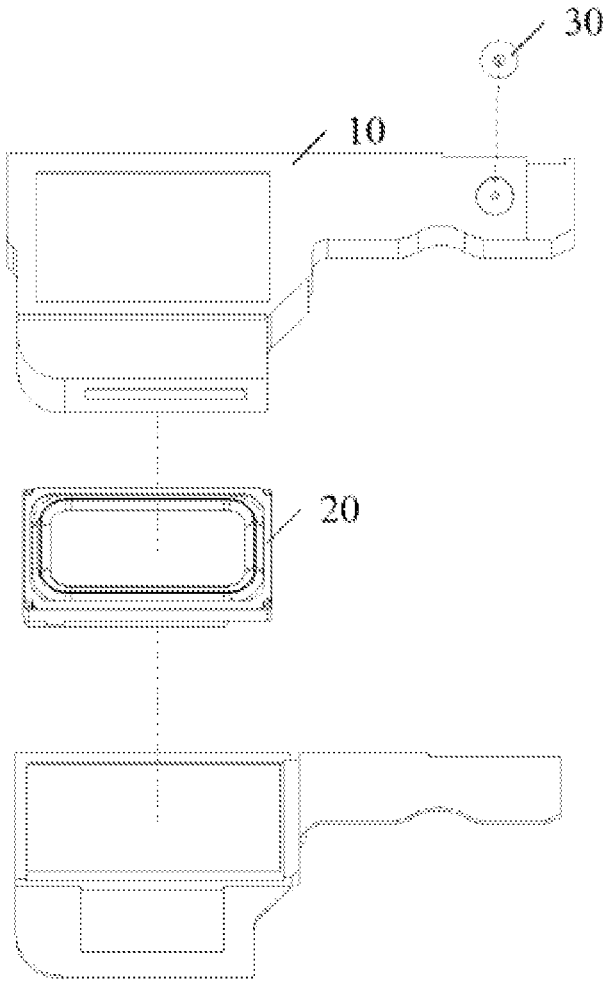
FIG. 1 shows an assembly structure view of a loudspeaker module.

Hereinafter, in order to explain the present disclosure more clearly, the present disclosure will be further described with reference to preferred embodiments and the drawings. Similar components in the drawings are denoted by the same reference numerals. Those skilled in the art would understand that the embodiments specifically described below is illustrative rather than restrictive, and are intended to limit the scope of the present disclosure.

Figure 2:
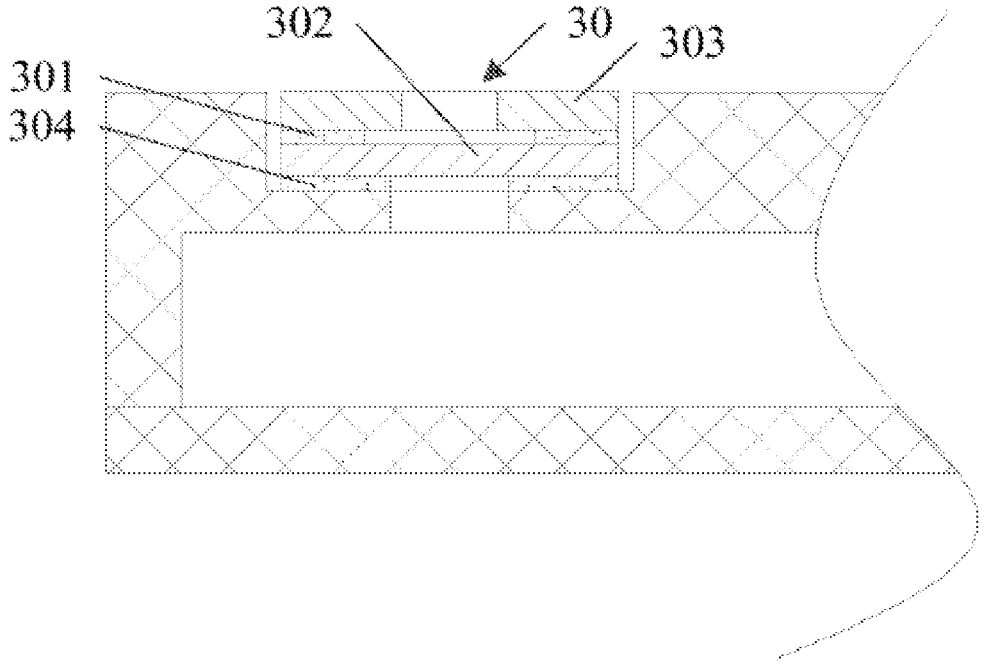
FIG. 2 shows a partially cross-sectional view of the loudspeaker module.

As shown together in FIG. 1 and FIG. 2, a loudspeaker module according to present embodiment comprises a housing 10 and a loudspeaker unit 20 accommodated in the housing 10. The loudspeaker unit 20 divides an inner chamber of the module into a front chamber and a rear chamber. A leakage hole is formed on the housing 10 at a position corresponding to the rear chamber. A damping member 30 covering the leakage hole is fixed on the housing 10 at an area around the leakage hole. The damping member 30 comprises a sound-permeable damping film 302 and a supporting member 303 bonded together by a first adhesive layer 301. The supporting member 303 has a first inner hole and is provided on an outer area of the damping film 302 in an annular shape, and the first adhesive layer 301 has a second inner hole and provided on an outer area of the supporting member 303 in an annular shape. A surface of the damping film 302 away from the supporting member 303 is adhered to an outer surface of the housing 10 by a second adhesive layer 304, and the second adhesive layer 304 has a third inner hole. Wherein a diameter of the first inner hole of the supporting member 303 is less than that of the second inner hole of the first adhesive layer 301. A buffer chamber is formed between an inner area of the supporting member 303 and the damping film 302. The buffer chamber is a chamber defined by the inner surface of the supporting member 303, the inner surface of the first adhesive layer 301 and an upper surface of the damping film 302, as illustrated in FIG. 2. Owe to the presence of the buffer chamber, one or more of reflection, eddy, resonance and stationary wave phenomena may occur in the buffer chamber when the gas flows to the outside via the leakage hole, thereby further improving the vibration amplitude symmetry of a vibrating diaphragm. In addition, the supporting member 303 may also function to shape the damping film 302, to effectively avoid wrinkles from occurring on the damping film 302 during the process of manufacturing or operating, to improve the appearance, and effectively improve a problem of the damping film warping during bonding, so that there may no gas leakage and the yield is improved.

In a specific embodiment, the diameter of the first inner hole of the supporting member 303 is less than or equal to that of the leakage hole. The buffer chamber formed in this way achieves a more intensive effect of one or more of reflection, eddy, resonance and stationary wave phenomena in the buffer chamber when the gas flows to the outside via the leakage hole, thereby achieving a more intensive effect of improving the vibration amplitude symmetry of the vibrating diaphragm.

In a specific embodiment, the first inner hole of the supporting member 303, the second inner hole of the first adhesive layer 301, the third inner hole of the second adhesive layer 304 and the leakage hole are disposed coaxially, i.e., center axial lines of the three inner holes and the leakage hole are all located in a straight line. The buffer chamber formed in this way achieves a more intensive effect of one or more of reflection, eddy, resonance and stationary wave phenomena in the buffer chamber when the gas flows to the outside via the leakage hole, thereby achieving a more intensive effect of improving the vibration amplitude symmetry of the vibrating diaphragm, and the damping member 30 is easier to be prepared.

In a specific embodiment, a diameter of the third inner hole of the second adhesive layer 304 is larger than that of the leakage hole. The buffer chamber formed in this way achieves a more intensive effect of one or more of reflection, eddy, resonance and stationary wave phenomena in the buffer chamber when the gas flows to the outside via the leakage hole, thereby achieving a more intensive effect of improving the vibration amplitude symmetry of the vibrating diaphragm.

In a specific embodiment, diameters of the second inner hole of the first adhesive layer 301 and the third inner hole of the second adhesive layer 304 may be the same so that the damping member 30 is easier to be prepared. However, the above diameters are not limited to be the same, and the above diameters may be selected according to the actual situation, i.e., may be different diameters.

In a specific embodiment, each of the first adhesive layer 301 and the second adhesive layer 304 is a double-sided adhesive tape, and a thickness of the first adhesive layer 301 is equal to or larger than 0.05 mm. According to an ordinary thickness of the housing 10 and an ordinary diameter of the leakage hole, the thickness of the first adhesive layer 301 equal to or larger than 0.05 mm may form an effective buffer chamber.

In a specific embodiment, the supporting member 303 is formed of metal materials or rigid plastic materials. The rigid plastic materials are one of PET (Polyethylene terephthalate), PC (Polycarbonate), PP (Polypropylene) or ABS (Acrylonitrile-butadiene-styrene), but not limited to those mentioned above, as long as it has certain rigidity. The material of the supporting member 303 selected according to the above makes it more rigid. On the one hand, since the supporting member 303 forms a portion of the buffer chamber, and is applied with a relatively larger force when the gas flows, a supporting member 303 with larger rigidity is not easily deformed or damaged; on the other hand, the supporting member 303 with larger rigidity may be more helpful in terms of shaping the damping film 302.

In a specific embodiment, the damping film 302 may be mesh cloth, a sound-permeable film or a non-woven fabric, and both of the mesh cloth or the sound-permeable film have good sound-permeable characteristics. Further, the mesh cloth may be a non-woven fabric. That is, the damping film 302 may be a non-woven fabric.

In the description of the present disclosure, it should be noted that orientations or relative positions indicated by the terms "upper", "lower", etc., which are based on an orientation or relative position shown in the drawings, are used only for the purpose of facilitating the description of the invention and simplifying the description, and not intended to indicate or imply that the referred devices or elements certainly are positioned at a specific orientation, or are configurated or operated at a specific orientation, and thus they cannot be construed as limitations on the present disclosure. Unless otherwise clearly specified and defined, the term "installation", "interconnection", or "connection" should be understood in a broad sense. For example, a "connection" may be a fixed connection, a detachable connection, or an integral connection; it may be a mechanical connection, or an electrical connection; it may be a direct connection, an indirect connection via an intermediary, or an inter connection between the two elements. Those of skilled in the art would understand the specific meanings of the above terms in the present disclosure according to the specific situations.

It should also be noted that in the description of the present disclosure, relational terms such as "first" and "second" are used only to distinguish one element or operation from another element or operation, and not necessarily require or imply that any such actual relationship or order is between these entities or operations. Moreover, the term "comprise", "include" or any other variant thereof are intended to cover non-exclusive inclusion, so that a process, method, article or apparatus that includes a series of elements comprises not only the elements, but also those not explicitly listed, or further comprises elements inherent to this process, method, article, or apparatus. Without further restrictions, the elements defined by the sentence "include one . . . " do not exclude that there are other identical elements in the process, method, article or apparatus that includes the element.

Apparently, the above embodiments of the present disclosure are only examples for clearly illustrating the present disclosure, rather than limiting the embodiments of the present disclosure. For those skilled in the art, other modifications or variations can be made on the basis of the above description. It is impossible to exhaustively list all the embodiments here, and any apparent modifications or variations derived from the technical solutions of the present disclosure are still within the scope of the present disclosure.

What is claimed is:

1. A loudspeaker module comprising:

a housing;

a loudspeaker unit accommodated in the housing and dividing an inner chamber of the loudspeaker module into a front chamber and a rear chamber;

a leakage hole formed on the housing at a position corresponding to the rear chamber; and a damping member covering the leakage hole, and being fixed on an outer surface of the housing at an area around the leakage hole, wherein the damping member comprises a sound-permeable damping film and a supporting member bonded together by a first adhesive layer, wherein the supporting member has a first inner hole and is provided on an outer area of the damping film in an annular shape, wherein the first adhesive layer has a second inner hole and is provided on an outer area of the supporting member in an annular shape, wherein a surface of the damping film away from the supporting member is adhered to an outer surface of the housing by a second adhesive layer, and the second adhesive layer has a third inner hole, and wherein a diameter of the first inner hole is less than that of the second inner hole, and a buffer chamber is formed between an inner area of the supporting member and the damping film.

2. The loudspeaker module of claim 1, wherein the diameter of the first inner hole is less than or equal to that of the leakage hole.

3. The loudspeaker module of claim 1, wherein center axial lines of the first inner hole, the second inner hole, the third inner hole and the leakage hole are located in a straight line.

4. The loudspeaker module of claim 1, wherein a diameter of the third inner hole is larger than that of the leakage hole.

5. The loudspeaker module of claim 1, wherein the diameter of the second inner hole is the same as that of the third inner hole.

6. The loudspeaker module of claim 1, wherein each of the first adhesive layer and the second adhesive layer is a double-sided adhesive tape, and a thickness of the first adhesive layer is equal to or larger than 0.05 mm.

7. The loudspeaker module of claim 1, wherein the supporting member is formed of metal materials or rigid plastic materials.

8. The loudspeaker module of claim 7, wherein the rigid plastic materials are PET, PC, PP or ABS.

9. The loudspeaker module of claim 1, wherein the damping film is mesh cloth or a sound-permeable film.

10. The loudspeaker module of claim 9, wherein the mesh cloth is a non-woven fabric.

* * * * *